US006533052B2

(12) United States Patent
Wentworth et al.

(10) Patent No.: US 6,533,052 B2
(45) Date of Patent: Mar. 18, 2003

(54) DRILL BIT FOR IMPACT-ASSISTED DIRECTIONAL BORING

(75) Inventors: Steven W. Wentworth, Brookfield, WI (US); Robert F. Crane, Oconomowoc, WI (US); Mark D. Randa, Summit, WI (US); Randy R. Runquist, Lovilia, IA (US); Richard K. Smith, Jr., Otley, IA (US)

(73) Assignees: Earth Tool Company, L.L.C., Oconomowoc, WI (US); Vermeer Manufacturing Company (US), Pello, IA (US)

( * ) Notice: Subject to any disclaimer, the term of this patent is extended or adjusted under 35 U.S.C. 154(b) by 63 days.

(21) Appl. No.: 09/767,106

(22) Filed: Jan. 22, 2001

(65) Prior Publication Data

US 2002/0096367 A1 Jul. 25, 2002

Related U.S. Application Data

(60) Provisional application No. 60/259,540, filed on Jan. 3, 2001.

(51) Int. Cl.[7] ..... E21B 10/00; E21B 10/56

(52) U.S. Cl. ..... 175/398; 175/415

(58) Field of Search ..... 175/415, 417, 175/418, 389, 19, 73, 76

(56) References Cited

U.S. PATENT DOCUMENTS 4,440,244 A * 4/1984 Wiredal ..... 175/292
4,962,822 A * 10/1990 Pascale ..... 175/258
5,052,503 A * 10/1991 Lof ..... 175/258
6,148,935 A 11/2000 Wentworth et al. ..... 175/398
6,371,223 B2 * 4/2002 Wentworth et al. ..... 173/135

FOREIGN PATENT DOCUMENTS

WO WO 00/55467 9/2000 ..... E21B/4/14

* cited by examiner

*Primary Examiner*—Thomas B. Will
*Assistant Examiner*—Meredith C. Petravick
(74) *Attorney, Agent, or Firm*—Philip G. Meyers

(57) ABSTRACT

A drill bit suited for impact-assisted directional boring in rock includes a bit body having a frontwardly facing, circular main cutting surface having a number of main cutting teeth disposed thereon. A gage cutter extends radially outwardly from the main cutting surface, which gage cutter mounts at least one frontwardly facing gage cutting tooth thereon suitable for cutting in a circle during straight boring and over an angle defined by less than a full rotation of the bit in order to steer the bit. A heel on an outer side surface of the bit body at a position opposite to and behind the gage tooth provides a reaction surface for the gage cutter. The bit body and gage cutter have a nearly circular side profile along a front portion thereof such that a maximum radial clearance between the side profile and a side wall of a hole being drilled is not greater than about 10 percent of the radius of a circle cut by the gage tooth.

12 Claims, 5 Drawing Sheets

DRILL BIT FOR IMPACT-ASSISTED DIRECTIONAL BORING

This application claims priority of U.S. Provisional Patent Application Ser. No. 60/259,540, filed Jan. 3, 2001.

TECHNICAL FIELD

The invention relates to directional boring and, in particular to an improved bit for impact-assisted directional boring.

BACKGROUND OF THE INVENTION

Directional boring apparatus for making holes through soil are well known. The directional borer generally includes a series of drill rods joined end to end to form a drill string. The drill string is pushed or pulled through the soil by means of a powerful hydraulic device such as a hydraulic cylinder, See Malzahn, U.S. Pat. Nos. 4,945,999 and 5,070,848, and Cherrington, U.S. Pat. No. 4,679,775 (RE 33,793). The drill string may be pushed and rotated at the same time as described in Dunn, U.S. Pat. No. 4,953,633 and Deken, et al., U.S. Pat. No. 5,242,026. A spade, bit or head configured for boring is disposed at the end of the drill string and may include an ejection nozzle for water to assist in boring.

In one variation, a series of drill string rods are used in combination with a percussion tool mounted at the end. The rods can supply a steady pushing force to the impact and the interior of the rods can be used to supply the pneumatic borer with compressed air. See McDonald et al. U.S. Pat. No. 4,694,913. This system has, however, found limited application commercially, perhaps because the drill string tends to buckle when used for pushing if the bore hole is substantially wider than the diameter of the drill string.

Accurate directional boring necessarily requires information regarding the orientation and depth of a cutting or boring tool, which almost inevitably requires that a sensor and transmitting device ("sonde") be attached to the cutting tool to prevent mis-boring and re-boring. One such device is described in U.S. Pat. No. 5,633,589, the disclosure of which is incorporated herein for all purposes. Baker U.S. Pat. No. 4,867,255 illustrates a steerable directional boring tool utilizing a pneumatic impactor.

Directional boring tools with rock drilling capability are described in Runquist U.S. Pat. No. 5,778,991, Cox U.S. Pat. No. 5,899,283 and Wentworth et al. PCT Publication No. 00/55467, published Sep. 21, 2000. The system of the foregoing PCT publication describes a bit for use in a drill head provided with a pneumatic impactor and a sonde housing. A gage tower sticks out radially from an otherwise generally round bit body defining the main cutting surface, giving the bit a keyhole shape. Loose stones from the wall of the borehole tend to fall into the spaces between the gage tower and the main cutting surface of the bit, especially during steering, sometimes causing the bit to jam.

FIG. 1A–1C illustrate a keyhole-shaped bit 5 in a series of positions defining a cutting arc for steering through a rocky formation according to the foregoing PCT publication. A stone 6 is in a jamming position next to the gage tower 7. The distance $M_1$ represents the maximum clearance between the bit and the wall of the borehole 8 being drilled. This clearance has been measured as 0.46 inch for a bit sized to drill a 4 inch hole, and represents approximately 23% of the 2 inch radius of the gage cutting teeth 9 from the bit's axis of rotation. The present invention reduces this clearance without otherwise compromising bit performance.

SUMMARY OF THE INVENTION

A drill bit for directional boring according to the invention includes a bit body having a frontwardly facing, circular main cutting surface having a number of main cutting teeth disposed thereon, a gage cutter extending radially outwardly from the main cutting surface, which gage cutter mounts at least one frontwardly facing gage cutting tooth thereon suitable for cutting in a circle during straight boring and over an angle defined by less than a full rotation of the bit in order to steer the bit, and a heel on an outer side surface of the bit body at a position opposite to the gage tooth, which heel provides a reaction surface for the gage cutter. The bit body and gage cutter have a nearly circular side profile along a front portion thereof, such that a maximum radial clearance between the side profile and a side wall of a hole being drilled is not greater than about 10 percent, preferably from 2% to 7%, of the radius of the circle cut by the gage tooth.

The side profile may be defined by the gage cutter alone, if the gage cutter extends all the way around the main cutting surface, or by the gage cutter and bit body in combination, if the gage cutter extends part way around the main cutting surface. The side profile is preferably not perfectly circular in cross section, and may instead be slightly ovoid or a composite of two or more arcs (radii) that merge together to resemble an oval or ellipse. The side profile is rounded around the entire periphery of the bit (360°), except at locations where small grooves or flats are provided as channels. These small indentations in the side of the bit body have limited width and depth and do not tend to cause jamming problems, and therefore are not considered when computing the maximum radial clearance of the side profile. Providing such a rounded profile on the side of the bit near its front end reduces or eliminates problems with jamming due to loose stones or rocky debris.

As in the prior Wentworth et al. PCT publication, the main cutting surface of the bit is preferably substantially flat and circular and has fluid ejection ports thereon, and the bit body has passages for conducting a drill fluid there through to the ejection ports. The heel of the bit may be provided by the metal of the bit body, protruding studs, or a combination thereof, and serves to provide a clearance by which the bit can rise in the steering direction as described further hereafter. In a preferred embodiment, the undersurface of the bit body at the heel is slightly inclined inwardly (towards the bit's axis of rotation) to make it easier for the bit to rise in as it travels forward.

For purposes of the invention, the terms "generally round" or "generally circular" include a cross-sectional shape that is truly round, or one that looks approximately round but is actually ovoid, elliptical or a composite of arcs that blend with one another each based on different diameter circles. A bit with a gage tower having side walls that stick out from an otherwise circular rim, as shown in FIG. 35 of the foregoing Wentworth et al. PCT application and FIGS. 1A–1C described above, is not generally circular by this definition. The meaning of "nearly round" or "nearly circular" according to the invention is the same as "generally round" or "generally circular", except that a completely round shape is excluded. These and other aspects of the invention are discussed in the detailed description that follows.

BRIEF DESCRIPTION OF THE DRAWINGS

In the accompanying drawings, like numerals represent like elements except where section lines are indicated.

DETAILED DESCRIPTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention and are not to delimit the scope of the invention.

Figure 4:
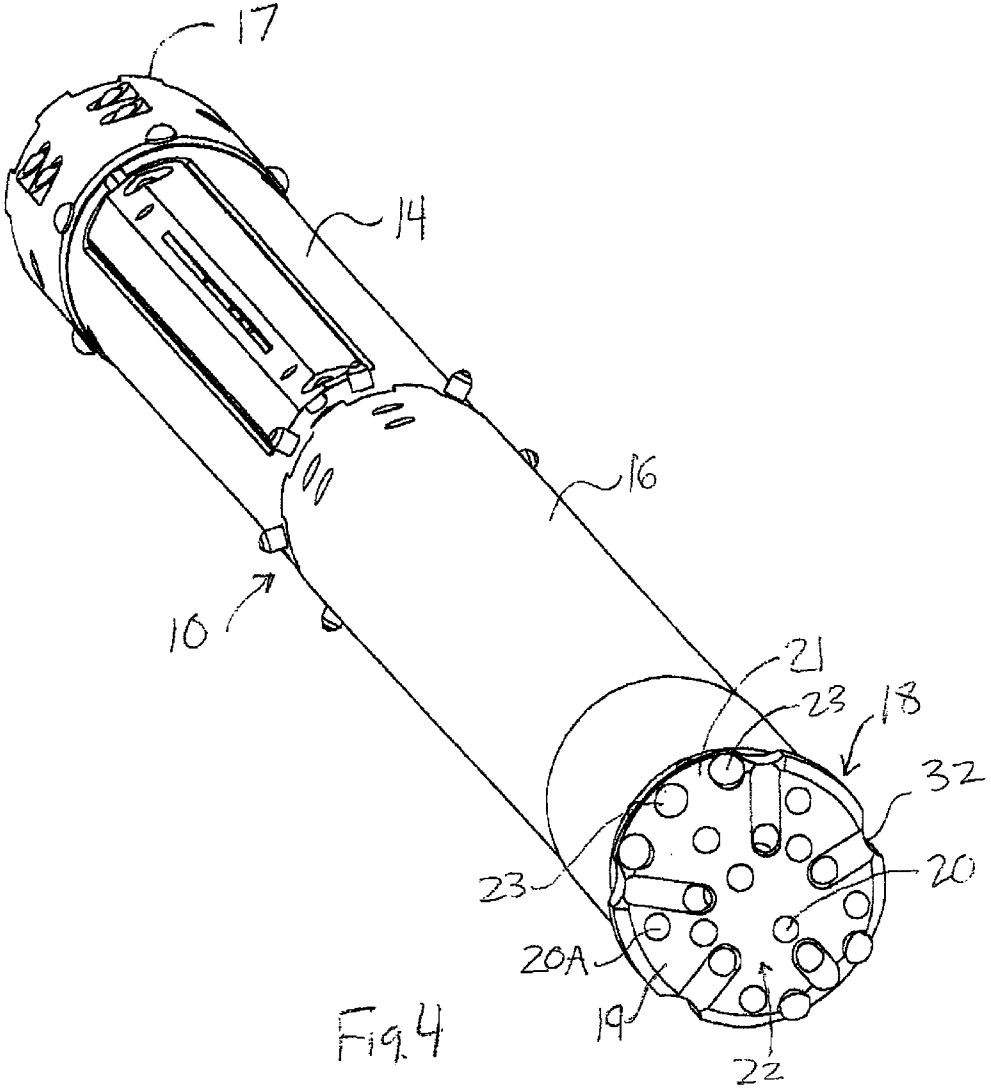
FIG. 4 is a perspective view of a drill head using a drill bit according to the invention.
Figure 5:
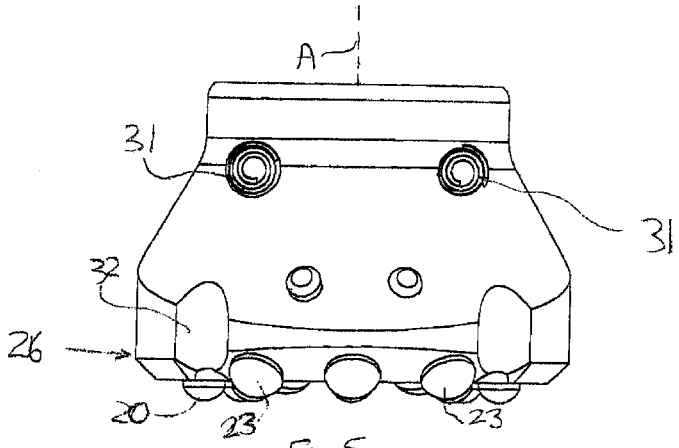
FIG. 5 is a top view of the bit shown in FIG. 4.
Figure 6:
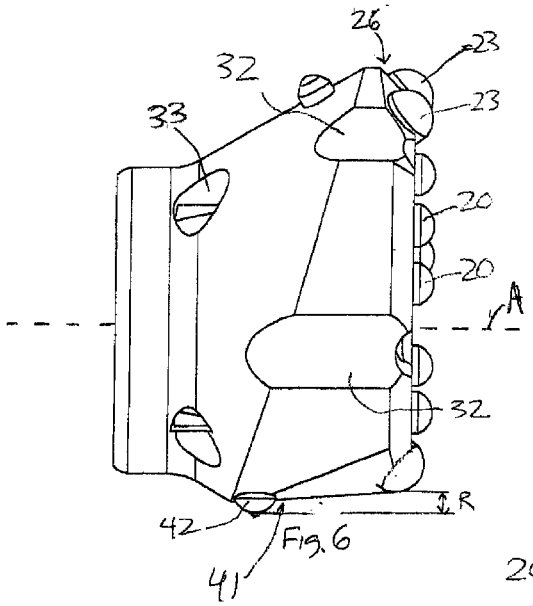
FIG. 6 is a side view of the bit shown in FIG. 4.
Figure 7:
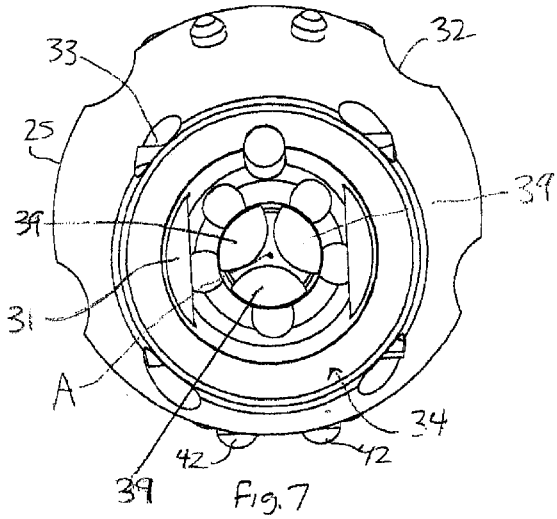
FIG. 7 is a rear view of the bit shown in FIG. 4.
Figure 8:
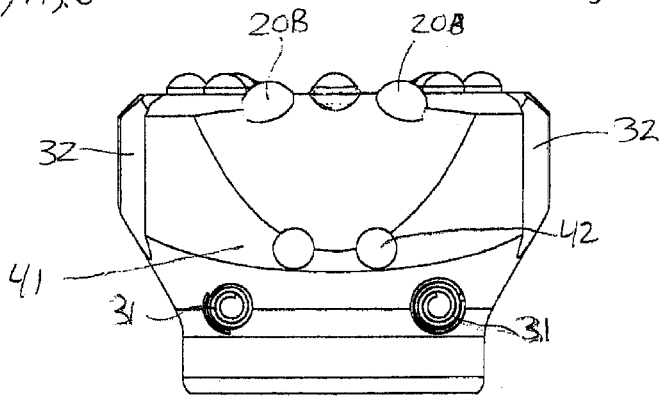
FIG. 8 is a bottom view of the bit shown in FIG. 4.
Figure 9:
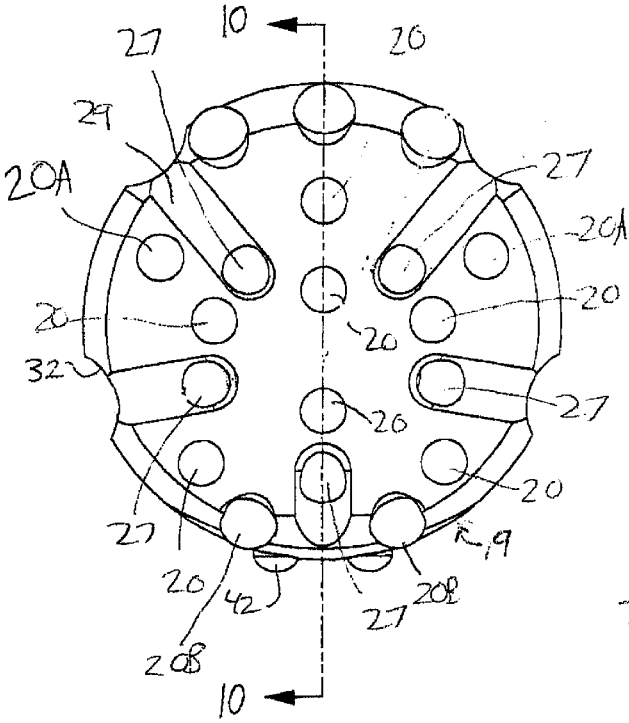
FIG. 9 is a front view of the bit shown in FIG. 4.
Figure 10:
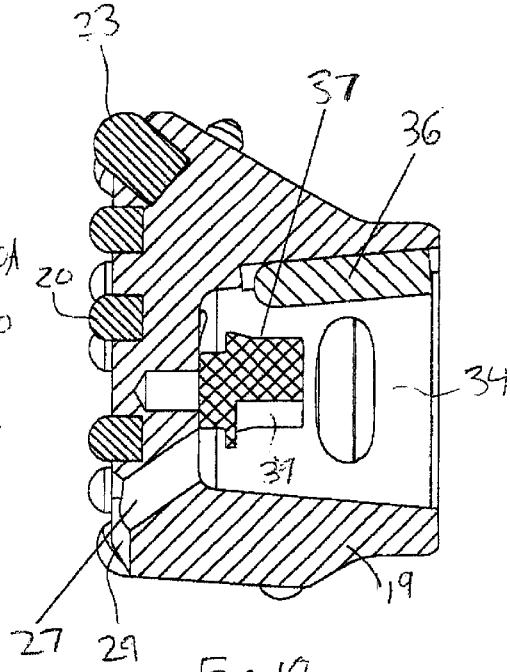
FIG. 10 is a sectional view taken along the lines 10—10 in FIG. 9.

Referring now to FIG. 4, drill head 10 according to the invention includes, as general components, a sonde housing 14, an impactor such as a pneumatic hammer 16, and a bit assembly 18, all connected head-to-tail as shown. A starter rod connects the rear splined end 17 of sonde housing 14 to the front end of a conventional drill string driven by a directional boring machine. Compressed air is fed through the drill string, starter rod and sonde holder 14 to operate the hammer 16. A sonde positioned in sonde holder 14 provides the operator on the surface with information such as the tool depth and position, and also the orientation of the gage cutter of the bit so that the operator can control the direction in which the bit steers. With the exception of drill bit assembly 18 including a bit 19 of the invention, these components are substantially as described in Wentworth et al. PCT Publication No. 00/55467, published Sep. 21, 2000 and also Wentworth et. al. U.S. Ser. No. 09/517,967, filed Mar. 3, 1999, the disclosures of which applications are incorporated by reference herein for all purposes.

Turning now to FIGS. 3–8, bit 19 includes a generally circular front face or main cutting surface 22 having an array of cutting teeth in the form of rounded tungsten carbide buttons 20. Bit 19 also has a gage cutter 21 that mounts one or more gage cutting teeth 23. The cutting surfaces of teeth 23 define an arc. Preferably there are at least two, especially three gage cutting teeth 23, e.g., one at the center of cutter 21 and two others equally spaced from it. However, even a single gage tooth 23 may prove sufficient. Gage teeth 23, like teeth 20, are most preferably round-headed tungsten carbide buttons.

Figure 3:
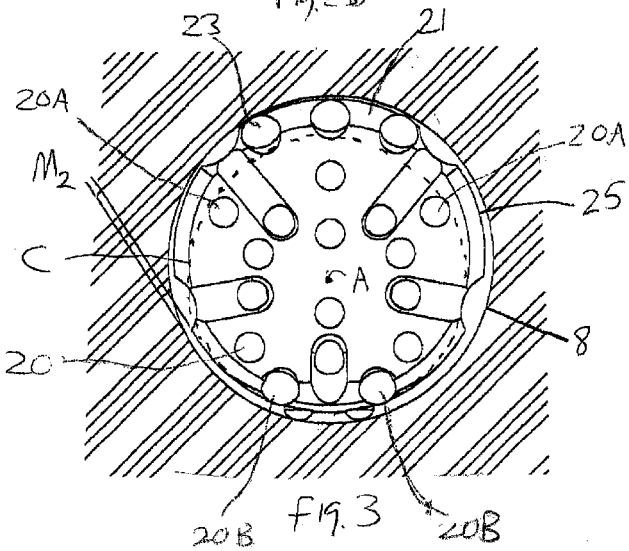
FIG. 3 is a front view of a drill head according to the invention in a position for straight boring.

In the preferred embodiment shown, gage cutter 21 takes the form of a rounded, crescent-shaped flange adjacent to but radially outward of main cutting surface 22. For this purpose, main cutting surface 22 comprises the front bit face centered on the axis A of drill head rotation and defined by the radius from axis A of the outermost tooth 20. In this example, teeth 20A and 20B cut in a circle C that defines main cutting surface 22 (FIG. 3). The portion of the front face of the bit lying radially outwardly of circle C comprises the gage cutter 21, which has a maximum width at the center gage tooth 23 and tapers to extinction at bottom reaction teeth 20B. The radius of main cutting surface 22 is generally in the range of 60–90%, especially 70–80% of the radius of teeth 23 from axis A.

An outer portion of gage cutter 21 slopes rearwardly from main cutting surface 22 to reduce wear and provide a suitable mounting surface for teeth 23, which are preferably angled upwardly (outwardly) at an acute angle such as in the range of from 30°–60° (see FIG. 6) relative to the axis of rotation A of the drill head 10. This puts teeth 23 at a suitable angle for attacking the borehole along an arc-shaped section in order to steer the drill head in a desired direction through rock. Main surface 22 may be flat as shown or outwardly rounded (convex), so long as the shape of surface 22 does not hinder steering using gage cutter 21.

Unlike the gage tower of the foregoing prior Wentworth et al. PCT publication shown in FIGS. 1A–1C, gage cutter 21 has a rounded side profile 25, giving a front end portion 26 of bit 19 a near-circular shape. The need to maintain a generally circular side profile is mainly at the front end of bit 19, and thus front end portion 26 may be of shallow depth (e.g., one inch or less.) Front end portion 26 may by cylindrical, frustoconical, or a combination thereof as shown. Rounded side profile 25 is interrupted by four spaced, shallow, rounded grooves 32 that carry debris and fluid away from each fluid outlet port 27 and an adjoining radial channel 29 in main cutting surface 22.

Bit assembly 18 includes a bit shaft which is used to mount the bit 19 onto the front end of the hammer 16 as described in the foregoing PCT publication. Bit 19 is removably mounted to the bit shaft by means of roll pins 31 inserted through transverse holes 33. Transverse holes 33 intersect a rearwardly opening recess 34 that receives the front end of the bit shaft. Bit assembly 18 moves axially over a limited distance each time the internal striker of hammer 16 delivers a blow to bit assembly 18. Fluid ports 27 run from the bottom of recess 34 to main cutting surface 22 to eject compressed air or fluid (drilling foam) from hammer 16 out of the front of bit 19 in order to lubricate the hole. A key 36 aids in transmitting torque from the bit shaft to bit 19, and a debris valve 37 may be provided in the space between the front end opening of the bit shaft and bottom of recess 34. Debris valve 37 moves axially from an extended position when the hammer 16 is running to a retracted position when the hammer 16 is stopped. Cutaways 39 are provided so that drilling fluid can pass by valve 37 to reach passages 27 when the valve is extended. When debris valve 37 is in its retracted position, it effectively plugs the front end opening of the bit shaft, preventing debris and drilling fluid from re-entering the hammer from bit 19 and potentially fouling the impact mechanism.

Figure 2A:
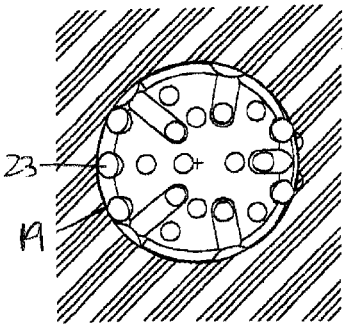
FIGS. 2A to 2C are front views of a drill bit according to the invention in successive positions for steering.
Figure 2B:
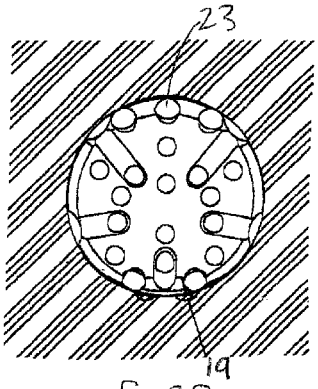
Figure 2C:
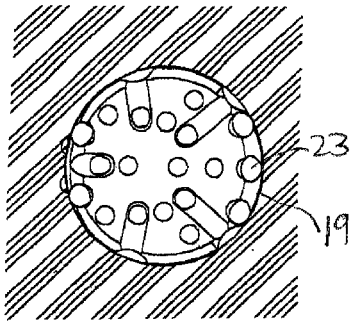

A heel portion 41 of bit 19 is preferably provided with a pair of teeth (carbides) 42 which extend in an opposing direction relative to gage teeth 23 and which are preferably rearwardly offset from teeth 23. Teeth 42 together with reaction teeth 20B at the edge of main cutting surface 22 opposite teeth 23 engage the borehole wall to provide a reaction surface for teeth 23. When bit 19 is boring straight ahead as shown in FIG. 3, teeth 42 (or a corresponding part of the bit body) engage the sidewall 8 of the hole, whereas front teeth 20B are spaced from the sidewall of the hole. When bit 19 is used to steer as shown in FIGS. 2A–2C, showing the left, middle and right positions in cutting an arc, the rise at heel portion 41 puts both teeth 42 and 20B in engagement with the sidewall 8. Sidewall 8 rises, either stepwise or at a slant, such that teeth 42 extend below the lower front corner of the borehole as shown. The extent of the rise R (FIG. 6) for a 4" bit as shown is preferably at least 0.1 inch, especially 0.12 inch. Although it is not required that heel portion 41 be forwardly inclined towards axis A, this aids in steering the drill head.

Figure 1A:
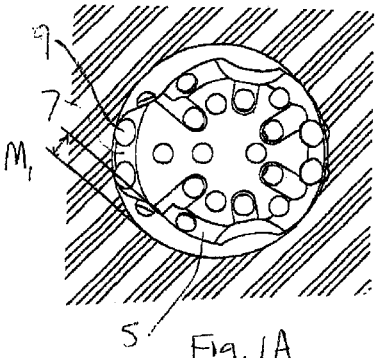
Fig. 1A PRIOR ART
FIGS. 1A to 1C are front views of a prior art keyhole-shaped drill bit in successive positions for steering.
Figure 1B:
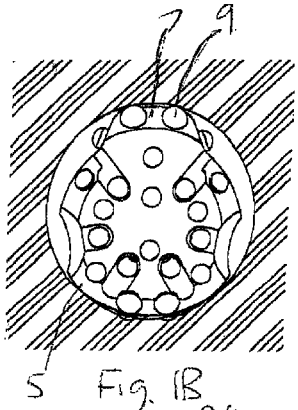
Fig. 1B PRIOR ART
Figure 1C:
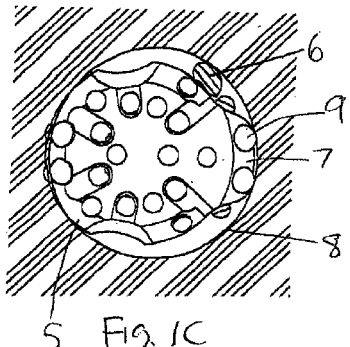
Fig. 1C PRIOR ART

FIGS. 2A–2C and 3 compare the geometry of bit 19 with the known keyhole-shaped bit of FIGS. 1A–1C. The distance $M_2$ represents the maximum clearance between the rounded side profile of front portion 26 of bit 19 and the wall of the borehole 8 during steering. This clearance has been measured as about 0.1 inch for a bit sized to drill a 4 inch hole. Such a clearance represents approximately 5% of the radius (2 inches) of the gage cutting teeth 23 from the bit's axis of rotation A. It has been found keeping this clearance to a minimum while maintaining a near-circular side profile provides a bit with substantially better steering action in rock than a bit that is oblong, that is, one that has a gage tower or similar cutting projection with open space on its sides where a loose stone could become lodged.

Figure 11:
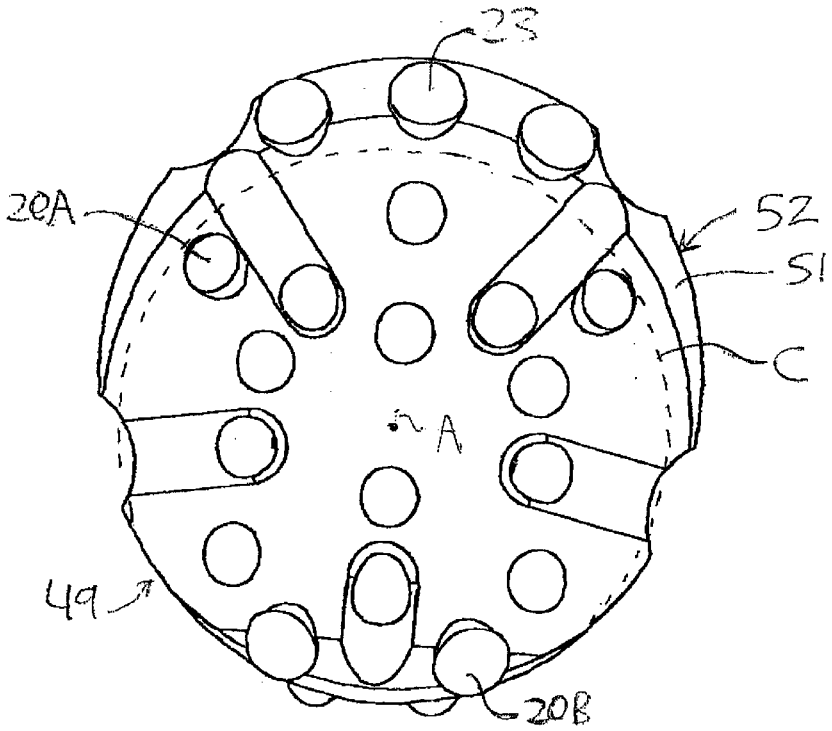
FIG. 11 is a front view of bit according to a second embodiment of the invention.
Figure 12:
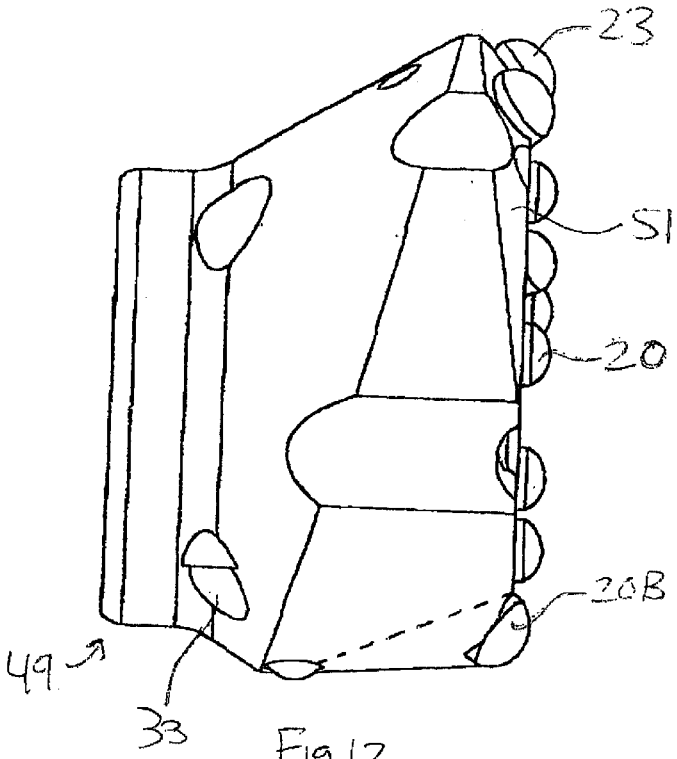
FIG. 12 is a side view of the bit shown in FIG. 11.

FIGS. 11 and 12 illustrate a further embodiment of a bit 49 of the invention similar to bit 19, except that the rearwardly sloped portion 51 of a gage cutter 52 is shorter, ending about half way around the circumference of the bit body as shown. Such a crescent shaped rearwardly sloped surface is preferred, but the front surface of the gage cutter of the invention may be entirely coplanar with the main cutting surface 22.

While certain embodiments of the invention have been illustrated for the purposes of this disclosure, numerous changes in the invention presented herein may be made by those skilled in the art, such changes being embodied within the scope and spirit of the present invention as defined in the appended claims.

What is claimed is:

1. A drill bit for directional boring, comprising:

a bit body having a frontwardly facing, circular main cutting surface having a number of main cutting teeth disposed thereon;

a gage cutter extending radially outwardly from the main cutting surface, which gage cutter mounts at least one frontwardly facing gage cutting tooth thereon suitable for cutting in a circle during straight boring and over an angle defined by less than a full rotation of the bit in order to steer the bit; and a heel on an outer side surface of the bit body at a position opposite to the gage tooth, which heel provides a reaction surface for the gage cutter;

wherein the bit body and gage cutter have a nearly circular side profile along a front portion thereof such that a maximum radial clearance between the side profile and a side wall of a hole being drilled is not greater than 10 percent of the radius of a circle cut by the gage tooth.

2. The drill bit of claim 1 wherein the gage cutter is substantially crescent-shaped in cross section, having a maximum width at the gage tooth.

3. The drill bit of claim 1 wherein the heel extends radially outwardly further than the main cutting surface at a location rearwardly offset from the main cutting surface.

4. The drill bit of claim 3 wherein the heel comprises a radially outwardly extending tooth.

5. The drill bit of claim 1 wherein the gage cutter is substantially crescent-shaped in cross section and has a plurality of gage cutting teeth that lie on an arc.

6. The drill bit of claim 5, wherein the gage cutter has a maximum width at the center of the arc defined by the gage teeth.

7. The drill bit of claim 1, wherein the maximum radial clearance between the side profile and a side wall of a hole being drilled is not greater than about 5 percent of the radius of the circle cut by the gage tooth.

8. The drill bit of claim 1, wherein the maximum radial clearance between the side profile and a side wall of a hole being drilled is in the range of about 2 to 7 percent of the radius of the circle cut by the gage tooth.

9. The drill bit of claim 1, wherein the main cutting surface lies in a plane perpendicular to a longitudinal axis of rotation of the bit, and has a number of carbide buttons set therein at varying distances from the longitudinal axis of rotation of the bit, and has drilling fluid outlet ports opening thereon.

10. The drill bit of claim 9, wherein the gage cutter comprises a crescent-shaped extension of the main cutting surface.

11. The drill bit of claim 10, wherein the gage cutter has a rearwardly sloped, frontward facing peripheral surface in which the gage cutting tooth is mounted.

12. The drill bit of claim 10, wherein the gage cutting tooth comprises a round-headed button that extends outwardly at an angle in the range of 30 to 60 degrees relative to the axis of rotation of the bit.

* * * * *